United States Patent [19]

Ronning

[11] 4,193,208

[45] Mar. 18, 1980

[54] SINGLE PASS ALFALFA DEHYDRATOR DRYER AND FLIGHTING THEREFOR

[75] Inventor: Richard L. Ronning, Overland Park, Kans.

[73] Assignee: Ronning Engineering Company, Inc., Overland Park, Kans.

[21] Appl. No.: 852,690

[22] Filed: Nov. 18, 1977

[51] Int. Cl.[2] ..... F26B 11/04

[52] U.S. Cl. ..... 34/131; 34/136; 432/105; 432/118; 366/225

[58] Field of Search ..... 34/108, 134, 135, 136, 34/137, 130, 109, 141, 142, 131, 132, 85, 79; 432/118, 105; 366/225, 226, 228, 229

[56] References Cited

U.S. PATENT DOCUMENTS

| | | | |
|---|---|---|---|
| 2,959,869 | 11/1960 | Ackerman | 34/135 |
| 3,387,380 | 6/1968 | Pritts | 34/79 X |
| 3,538,614 | 9/1968 | Weimer et al. | 34/79 X |
| 3,751,218 | 8/1973 | Cherenson | 432/118 X |
| 3,861,055 | 1/1975 | Thompson | 34/108 X |
| 3,950,861 | 4/1976 | Weimer et al. | 432/118 X |

FOREIGN PATENT DOCUMENTS

| | | | |
|---|---|---|---|
| 17397 | 8/1956 | Fed. Rep. of Germany | 432/118 |

*Primary Examiner*—Albert J. Makay
*Assistant Examiner*—Henry Bennett
*Attorney, Agent, or Firm*—Schmidt, Johnson, Hovey & Williams

[57] ABSTRACT

The rotatable dryer drum in a dehydrator for crop material is provided with a plurality of centrally disposed flighting panels for escalating turbulence in the material-entraining heated airflow passing through the drum as well as to increase the available heat transfer area, thereby significantly improving the efficiency of the dehydrator. The panels are supported in offset, thermally isolated relation to the sidewall of the drum by a series of elongate struts spaced along the length of the drum and extending between the sidewall and the panels such that the flighting resists thermal warpage and requires only a minimum amount of welding for installation. In preferred forms there is provided a drop-out chamber adjacent the drum outlet for collecting material separated from the airflow, the chamber having a mechanical conveyor for bulk discharge of the collected material. A return duct from the outlet of the drum to its inlet adjacent the burner is provided for recycling a portion of the heated airflow thereby reducing fuel requirements for the burner and further increasing the efficiency of the dehydrator.

9 Claims, 5 Drawing Figures

SINGLE PASS ALFALFA DEHYDRATOR DRYER AND FLIGHTING THEREFOR

BACKGROUND

This invention relates to single pass dehydrators in general and particularly concerns an improved dryer drum for such dehydrators which drum has central flighting structure supported in offset, thermally isolated relation to the drum sidewall for increasing the efficiency of the dehydrator.

In the past, it was conventional practice to force-dry alfalfa and similar crops immediately after cutting in order to eliminate potential damage to crops left in the field for sun curing. Moisture content of crops processed in this manner typically ranges as much as 78 percent such that the crops are able to withstand relatively high dryer inlet temperatures. Initially, dehydrators for drying these crops comprised a single pass system, the crop moving rectilinearly from a high temperature burner adjacent the inlet to the outlet of the dehydrator. Later, the more sophisticated three-pass system was developed wherein material is directed along a generally S-shape path of travel thereby providing desired long residence time in the dryer while at the same time requiring significantly less space than conventional single pass dryers.

As fuel costs have increased, it has become common practice to rely more heavily on the benefits of sun curing notwithstanding the risk of damage or loss resulting from leaving the cut crop in the field during the curing process. This technique appreciably reduces the moisture content of the crop presented to the dehydrator, and consequently correspondingly lowers the amount of fuel required to complete the drying process.

A problem with force-drying crop material which has been partially cured in the field is the fact that such material cannot withstand the high burner temperatures associated with the three-pass dehydration system used to process fresh cut crop. In this connection, the moisture content of field cured crops may be in the order of 13–15 percent which is simply not sufficient to protect the material against combustion under the influence of the high inlet temperatures in conventional three-pass systems. Moreover, merely reducing the inlet temperature of a three-pass dehydration system in order to process materials of lower moisture content would not be satisfactory inasmuch as the overall efficiency of the dehydration system would be unacceptably adversely affected.

Several attempts have been made to redesign the single pass dehydrator for efficient drying of low moisture content material, though none of these has been particularly successful. Typically the approach has been to increase the heat transfer surface and material residence time in the dryer by providing additional internal flighting structure. However, this approach has serious drawbacks from the stand-point of significantly increasing the initial cost of the dryer as well as presenting the problem with warpage of the flighting structure. In this latter regard, the flighting structure is typically supported on the dryer wall, the difference in thermal expansion between the flighting structure and the wall often resulting in unacceptable warpage of the structure. Of course, since the shape of the flighting structure is critical to the path of travel of the material through the dryer, deformation of the structure may significantly reduce the efficiency of the dehydration system.

One approach to the problem alluded to above has been the provision of central radiating flighting structure supported upon an elongate shaft mounted coaxially of the dryer drum. However, due to thermal stresses in the central flighting resulting from the manner in which it is supported upon the dryer drum, undesirable warpage and breakage has been experienced in the application of such dehydrators. Moreover, the long unsupported span presented by such structures requires the use of relatively expensive heavy-weight material to maintain the desired shape of the structure even under normal operating conditions.

BRIEF SUMMARY OF THE INVENTION

In view of the foregoing, the present invention concerns a single pass dehydrator having centrally disposed flighting structure supported to the dryer drum in a substantially thermally isolated manner whereby the integrity of the structure is maintained and the material residence time in the dryer is increased to the required level. Strategically positioned struts extend between the dryer sidewall and the central flighting structure along the length thereof such that the structure is physically secured to the dryer while at the same time being sufficiently thermally isolated from the dryer sidewall as to avoid warpage from unequal rates of thermal expansion and contraction. The struts also provide additional necessary rigidity to the flighting structure such that the latter may be constructed of relatively thin material thereby decreasing the overall cost of the dehydrator. Further in this connection, the unique manner in which the central flighting structure is supported on the dryer drum significantly reduces the time required for welding the flighting structure to the drum as compared to conventional dryers and hence, the overall cost of the dehydration system is additionally decreased.

An additional feature of the present invention is the provision of a return duct between the outlet and inlet of the dehydrator whereby a portion of the airflow therethrough is recycled in a manner to appreciably lower the amount of fuel required by the burner. A dropout chamber at the outlet of the dehydrator has a mechanical conveyor for removing the major portion of dried material from the dryer thereby facilitating final material separation from the airflow prior to recycling and exhaust of the latter.

DETAILED DESCRIPTION OF THE INVENTION

Figure 1:
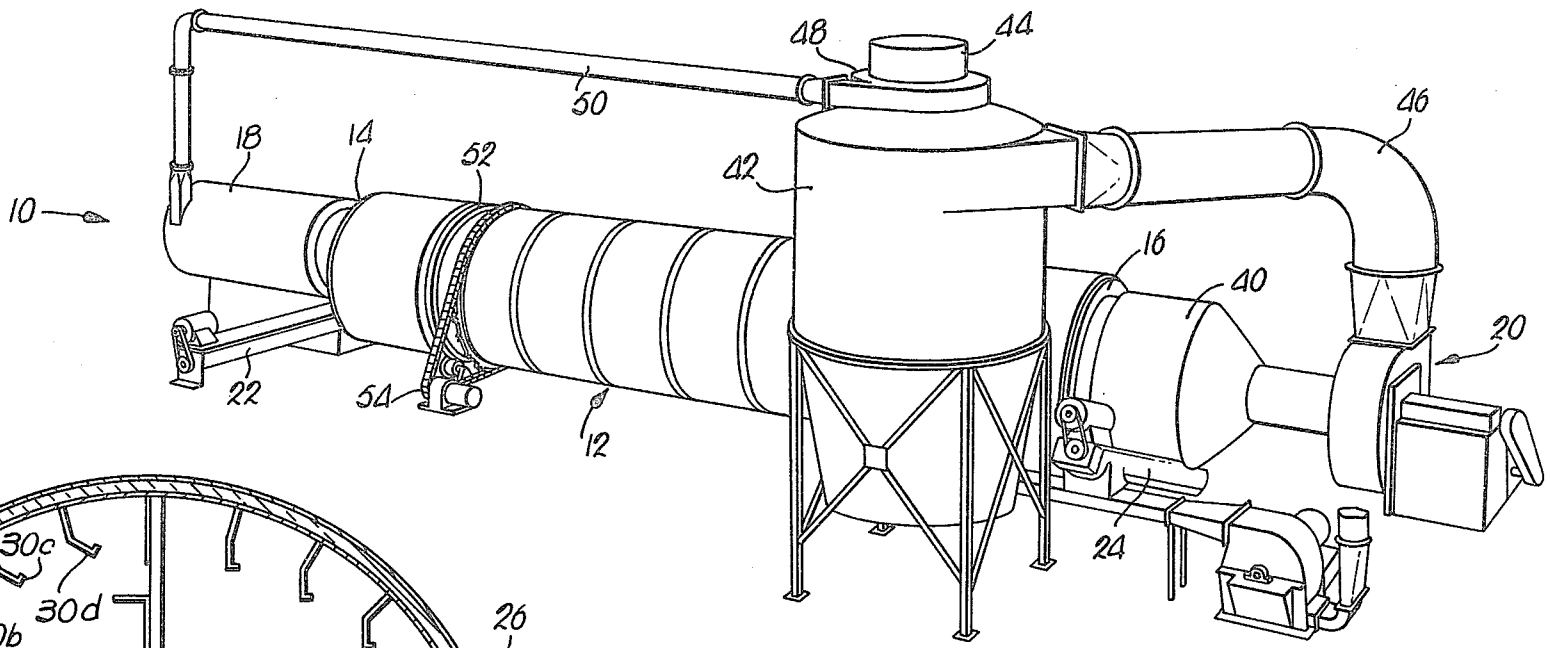
FIG. 1 is a perspective view of a single pass dehydration system constructed in accordance with the principles of the present invention.

In FIG. 1, there is shown a single pass dehydration system for alfalfa and similar crop material. The system 10 includes a generally horizontal, rotatable dryer drum 12 having an inlet end 14 and an opposed outlet end 16, a natural gas burner 18 in communication with the drum 12 adjacent the inlet end 14, and a fan 20 mounted at the outlet 16 for creating a negative pressure airflow through the drum 12. Additionally, there is provided a mechanical auger-type conveyor 22 for introducing wet crop material into the drum 12 at the inlet 14 and a second auger-type conveyor 24 adjacent the outlet 16 for removal of dried material.

Figure 2:
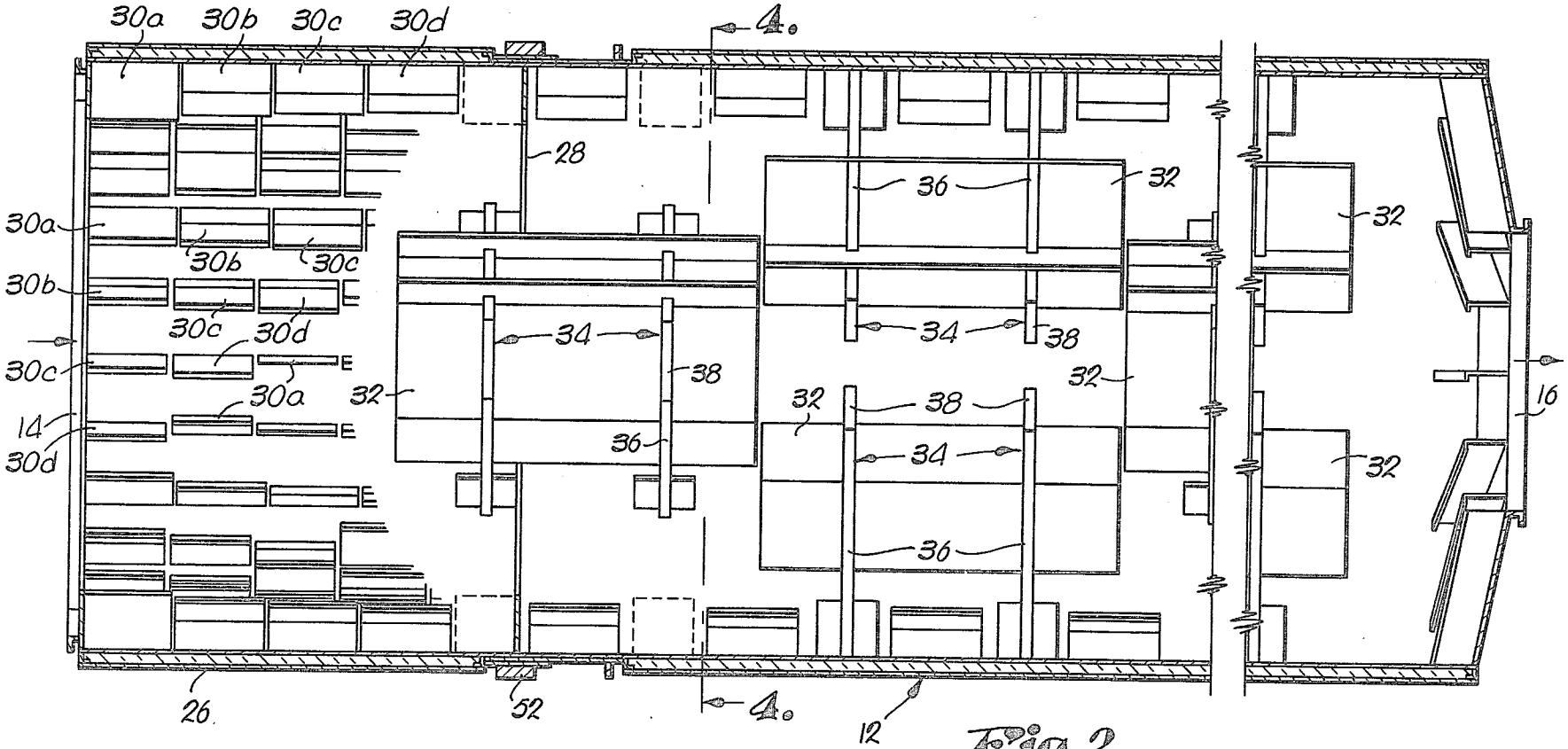
FIG. 2 is an enlarged, partial, longitudinal cross-sectional view of the dryer drum illustrated in FIG. 1 and having portions broken away for clarity.
Figure 3:
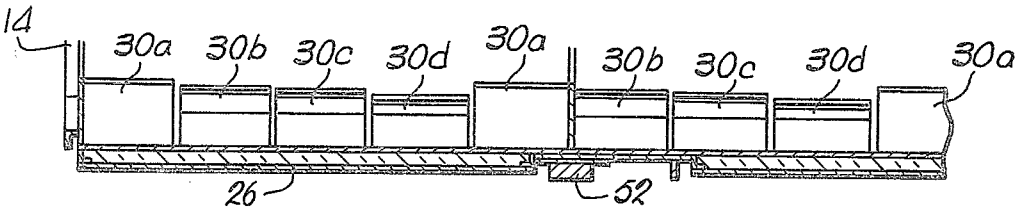
FIG. 3 is an enlarged, fragmentary, detailed view illustrating a typical arrangement of the outer flighting structure on the dryer sidewall and showing the latter in section.

The drum 12 has a generally cylindrical sidewall 26 of conventional insulated double-wall construction. The sidewall 26 extends substantially the full length of the drum 12 and is reinforced along its length by a number of annular reinforcing ribs 28 as illustrated in FIG. 2 (only one of which is shown).

Figure 5:
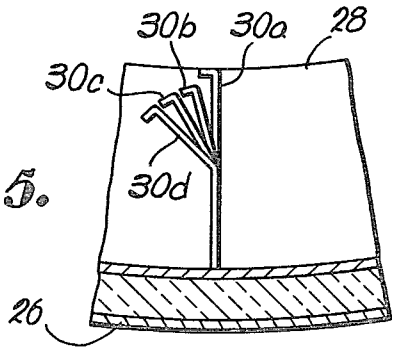
FIG. 5 is an enlarged, fragmentary, end view showing a typical arrangement of the outer flight structure on the dryer sidewall and showing the latter in cross section.

The interior surface of the wall 26 is provided with circumferential flighting structure in the form of a series of specially configured baffle plates 30*a*, 30*b*, 30*c*, and 30*d*. Each of the plates 30 extends generally radially from the sidewall 26 and has an inturned edge spaced from the latter. Further, the plates 30*b*, 30*c*, and 30*d* have progressively angled outermost segments as shown for example in FIG. 5.

The panels 30 are sequentially arranged in a plurality of longitudinally extending rows, the sequential arrangement of the plates 30 in each row being offset from the sequential arrangement of the plates in adjacent rows. By this construction, entrained material flowing through the drum 12 impinges against and is contacted by the plates 30 in a manner to produce desired heat transfer and residence time in the drum 12. Additionally, the plates 30 aid in tumbling material which has fallen-out of the airflow, as will be described infra.

Figure 4:
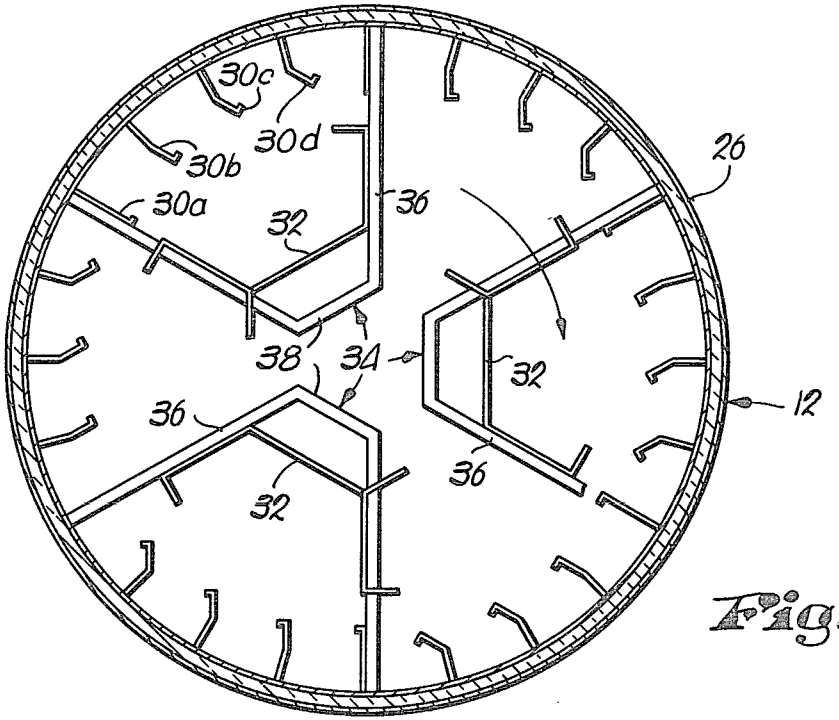
FIG. 4 is an enlarged cross-sectional view taken along line 4—4 of FIG. 2.

There further is provided central flighting structure in the form of multiple clusters of three elongate center flighting panels 32 each having a uniquely configured cross section as shown for example in FIG. 4. The panels 32 are each independantly supported on the sidewall 26 in offset relation to the latter by a plurality of generally U-shaped members 34 each presenting a pair of elongate struts or legs 36 extending generally radially inwardly from the sidewall 26, and a bight portion 38 interconnecting the innermost ends of the legs 36 adjacent the central axis of the drum 12. In preferred forms, the panels 32 are approximately 6 ft. long and are formed from a sheet having an undeformed width of 6 ft. such that there is provided approximately 72 sq. ft. of heat transfer surface on each panel 32.

A series of clusters of panels 32 arranged end-to-end, extends substantially the full length of the drum 12. While the panels 32 of each cluster are disposed symmetrically relative to one another in offset relation to the longitudinal axis of the drum 12, adjacent clusters are angularly offset 60° in order to provide desired resident time for the material flowing through the drum 12.

A large dropout chamber 40 is provided at the outlet end 16 for the purpose of collecting dried material from the airflow passing through the drum 12, the conveyor 24 being in direct communication with the chamber 40 such that collected material may be easily and efficiently unloaded from the drum 12.

There is also provided an exhaust system comprising an upstanding separator 42 having a vertical stack 44, a large duct 46 interconnecting the fan 20 and the separator 42, a stack skimmer 48 at the base of the stack 44 and a small duct 50 leading from the skimmer 48 to the burner 18 adjacent the inlet 14. The duct 46, separator 42, skimmer 48, and duct 50 collectively form a return duct intercoupling the outlet 16 with the inlet 14 for the purpose of recycling a portion of the exhaust gases from the drum 12.

The outer portion of the sidewall 26 has a pair of spaced circumferential trunnion tracks 52 (only one of which is shown in FIG. 1) adapted to be supported upon respective trunnions for the purpose of rendering the drum 12 axially rotatable. A power drive 54 function to rotate the drum 12 during operation of the dehydration system 10.

In utilizing the dehydration system 10, the fan 20 is actuated initially to create an airflow through the drum 12 from inlet 14 to the outlet 16. Burner 18 is then actuated and the power drive 54 is operated in a manner to rotate the drum 12 in a clockwise direction as viewed in FIG. 4.

Partially dried crop material such as alfalfa is introduced into the drum 12 at inlet 14 by the auger conveyor 22. The airflow through the drum 12 entrains material introduced at the inlet 14 causing the material to flow from the latter toward the outlet 16.

The burner 18 serves to heat the airflow and the crop material whereby water in the material is caused to become vaporized. In the preferred form, the temperature at the inlet 14 is 1800°–2000° F. when drying alfalfa having less than 60% moisture content. As the material moves through the drum 12, its progress is impeded by a random impingement against the plates 30 and the panels 32 such that the residence time of the material in the drum 12 is significantly increased. Material which impinges against the center flighting panels 32 and drops out of the main airflow at the center of the drum 12, is reintroduced into the central airflow by the rotary movement of the drum 12. In this latter connection, entrained material which falls-out of the airflow is collected by the plates 30 and carried upwardly until it gravitates back into the central flow and progresses further toward the outlet 16.

The movement of material through the drum 12 as described supra is an important feature of the present invention and is directly attributable to the presence of the center flighting panels 32. The repetitive fall-out and return of material to the central airflow significantly increases residence time in the dryer, thereby assuring complete drying of the material using lower inlet temperatures. In actual practice, a 12 ft.×60 ft. dryer constructed in accord with the principles of the present invention exhibits a material residence time of approximately 5 minutes as opposed to a 3 minute residence time for a three-pass dryer of comparable size.

Once the entrained material reaches the outlet 16, the bulk of the material is collected in the dropout chamber 40 whereupon it is unloaded from the drum 12 by operation of the conveyor 24. Some of the entrained material travels with the airflow through the fan 20 and duct 46 to the separator 42 whereupon it is segregated from the airflow in a manner well known in the art. As the airflow continues from the separator 42 upwardly through the stack 44, a portion of the airflow is drawn off by the stack skimmer 48 and returned to the burner 18 via duct 50.

In applying the principles of the present invention, it has been found that an assembly weighing only 200 pounds can add an additional 72 sq. ft. of heat transfer surface while requiring only 6 ft. of welding. This is particularly significant inasmuch as the efficiency of the dryer increases in relation to the amount of heat transfer surface presented by its internal flighting structure.

From the foregoing, it can be seen that the present invention offers an effective solution to drying crop material efficiently and effectively without damaging the dried material in any way. The unique arrangement of the center flighting panels 32 provides the necessary residence time for the material in order that the latter may be properly dried in a single pass system.

The particular arrangement of the U-shaped members 34 in supporting respective panels 32 renders the latter thermally insulated from the sidewall 26 while at the same time providing desired rigidity to the panels themselves. In this connection, the increased rigidity provided by the members 34 enables the panels 32 to be constructed of low cost, light-weight thin sheet stock without experiencing undesirable panel warpage. Moreover, the struts 36 of members 34 offer virtual thermal insolation for the panels 32 such that the latter are not susceptible to thermal stresses caused by varying rates of thermal expansion or contraction. A further advantage of this construction is the fact that significantly less welding is required to mount the panels 32 within the drum 12 than is the case with conventional methods of construction.

What I claim is:

1. A single pass dehydrator for drying moisture laden combustible material, said dehydrator including:

an elongate, generally horizontal, material-receiving hollow dryer drum having a sidewall, an inlet and an outlet;

means for creating an airflow from said inlet to said outlet whereby to entrain material at said inlet for conveyance through said drum;

a burner adjacent said inlet for heating said material and said airflow;

a number of elongate flighting panels disposed within said drum in offset relation to the longitudinal axis of the latter; and means mounting said panels on said drum in offset relation to the sidewall thereof, said mounting means including a plurality of elongate support struts spaced along the length of said drum, each strut extending generally transversely of the drum between the drum wall and said panels for supporting the panels against longitudinal buckling while at the same time spacing said panels from said sidewall of the drum, said struts being arranged in pairs, each pair of struts being interconnected to form a rigid U-shaped support for a respective panel.

2. The invention of claim 1; and a plurality of baffle plates extending radially inwardly from said sidewall.

3. The invention of claim 2; and mechanism for rotating said drum about its longitudinal axis whereby to trumble said material as the latter is conveyed through said drum.

4. The invention of claim 3; said panels being arranged in clusters of three, the panels in each cluster being symmetrically disposed around the longitudinal axis of said drum.

5. The invention of claim 4, there being a series of said clusters arranged end-to-end and extending substantially the full length of said drum.

6. The invention of claim 5, each of said clusters being angularly offset 60° relative to immediately adjacent clusters.

7. The invention of claim 1; and a dropout chamber adjacent said outlet for collecting entrained material from said airflow.

8. The invention of claim 7, said chamber having a mechanical conveyor for discharging dried material from said chamber.

9. The invention of claim 1; and a return duct intercoupling said outlet and said inlet exteriorly of said drum to permit recycling of a portion of said heated airflow through said drum whereby to reduce fuel requirements for the burner.

* * * * *